United States Patent [19]

White

[11] 4,088,373

[45] May 9, 1978

[54] HIGH VOLUME PNEUMATIC TANK

[75] Inventor: Charles F. White, Houma, La.

[73] Assignee: TBW Ind. Inc., Houma, La.

[21] Appl. No.: 713,525

[22] Filed: Aug. 11, 1976

[51] Int. Cl.[2] ..... B65G 53/38

[52] U.S. Cl. ..... 302/53

[58] Field of Search ..... 302/29, 45, 47, 52, 302/53, 54; 214/83.28, 15 D; 222/195; 259/DIG. 17

[56] References Cited

U.S. PATENT DOCUMENTS

| | | | |
|---|---|---|---|
| 2,524,919 | 10/1950 | Meincke | 302/53 |
| 2,915,340 | 12/1959 | Lusted | 302/53 |
| 2,924,489 | 2/1960 | Beckmann | 302/53 |
| 3,127,851 | 4/1964 | Auksel | 302/52 |
| 3,236,422 | 2/1966 | Bailey et al. | 222/195 |
| 3,275,197 | 9/1966 | Eklund | 302/29 |
| 3,301,280 | 1/1967 | Lau | 302/53 |

FOREIGN PATENT DOCUMENTS

| | | | |
|---|---|---|---|
| 1,129,892 | 5/1962 | Germany | 302/29 |
| 1,274,990 | 8/1968 | Germany | 222/195 |
| 1,283,147 | 11/1968 | Germany | 302/54 |

*Primary Examiner*—Evon C. Blunk
*Assistant Examiner*—Jeffrey V. Nase
*Attorney, Agent, or Firm*—Ranseler O. Wyatt

[57] ABSTRACT

A high volume pneumatic tank for vertical installation in a ship, or the like, having a pump, or air compressor, for selectively providing a supply of air for unloading pulverulent material aerating and pressurizing the contents of the tank including the discharge line from the tank to the point of discharge, and equalizing means for maintaining a balanced pressure in the tank, and the novel method of handling pulverulent material.

1 Claim, 5 Drawing Figures

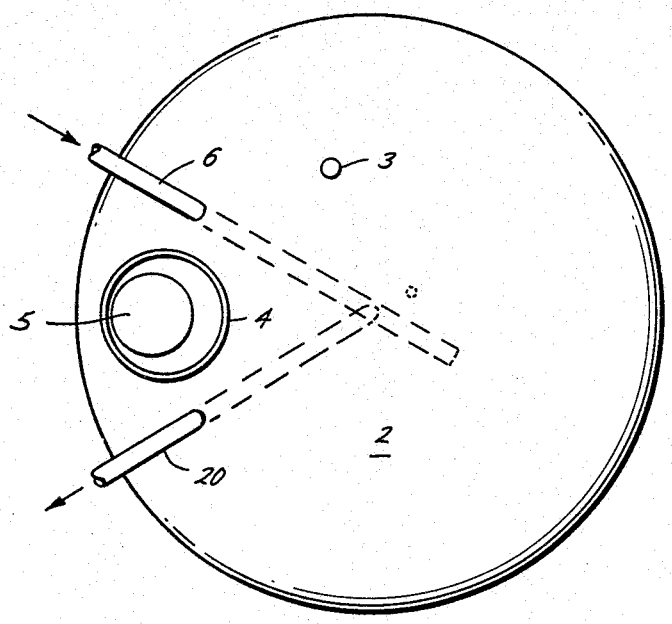
Fig. 3
Fig. 4
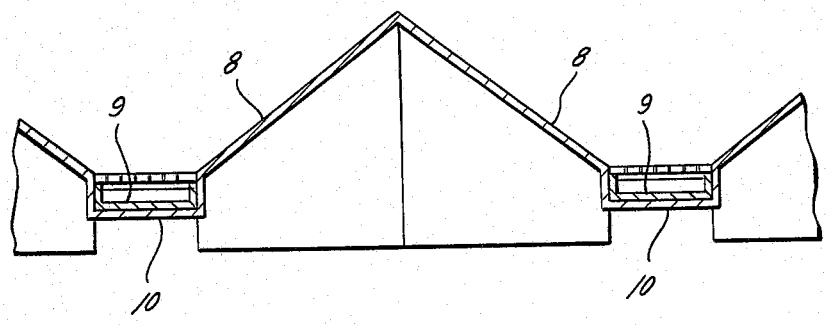
Fig. 5
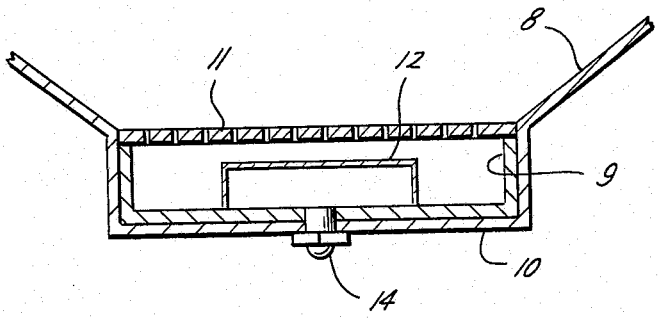

HIGH VOLUME PNEUMATIC TANK

BACKGROUND OF THE INVENTION

In sea-going ships, hold capacity is of great importance, and loading and unloading time is of equal importance. The unloading problem arises due to the fact that the storage facilities on shore are located remotely from the dock, and the usual gravity dump tanks, in such instance, are of no use. The object of the invention here referred to is to disclose a tank that will hold a maximum load and that will be provided with slope sheets and aerating means and with pressure equalization on both sides of the slope sheets to prevent damage thereto, as well as a method of handling pulverulent material to provide easy, quick loading and unloading, without contamination of the environment, or the product.

SUMMARY OF THE INVENTION

A high volume pneumatic tank having structurally identical heads at each end and slope sheets mounted therein tro direct the contents to a discharge opening and means for areating and pressurizing the contents of the tank to facilitate unloading thereof, a discharge line leading from said discharge opening to a remote discharge point, said discharge line being similarly aerated and pressurized during the unloading procedure, and the novel method of unloading pulverulent material consisting of aerating and pressurizing the contents of the tank, directing the flow of the aerated material into a discharge line, maintaining said pressure on said aerated contents to the tank and discharge line at a preselected degree until said tank is unloaded.

BRIEF DESCRIPTION OF THE DRAWINGS

FIG. 3 is a top view of the tank, showing the inlet and outlet lines, and the manhole.

FIG. 4 is an enlarged, cross sectional view, taken on the line 4—4 of FIG. 2, showing the slope sheets and aerating slides, and FIG. 5 is an enlarged, cross sectional view, taken on the line 5—5 of FIG. 2, showing the air difusing device and the slides, in cross section.

DESCRIPTION OF THE PREFERRED EMBODIMENT

Figure 1:
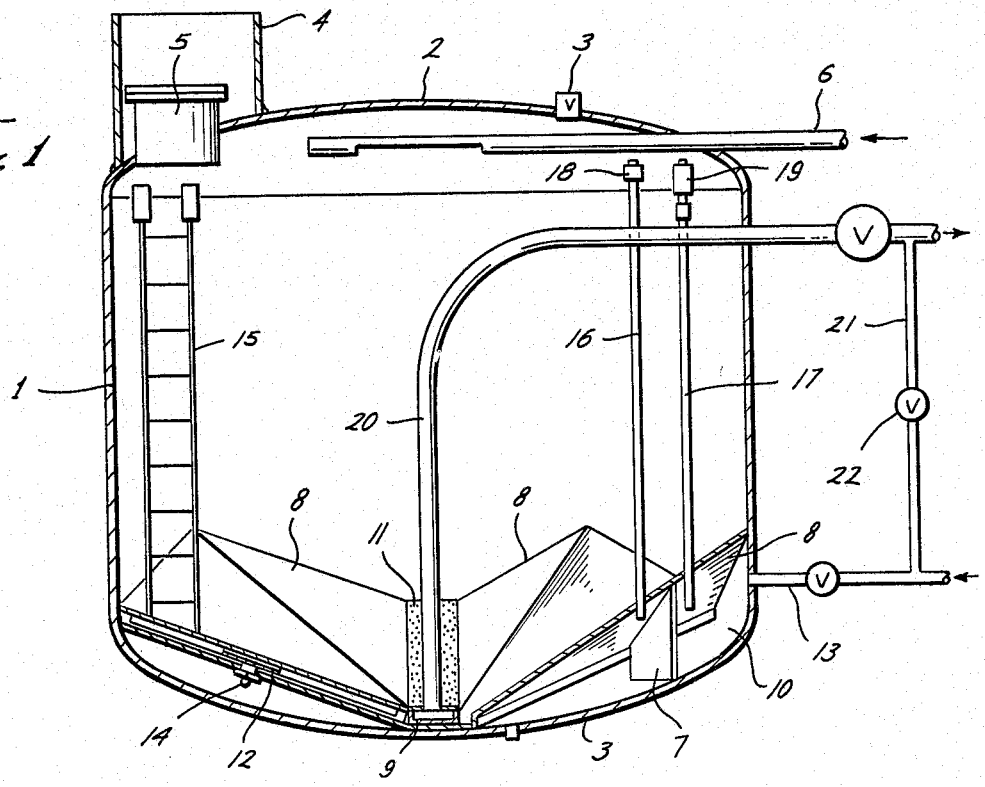
FIG. 1 is a side elevational view of the tank, in vertical cross section.
Figure 2:
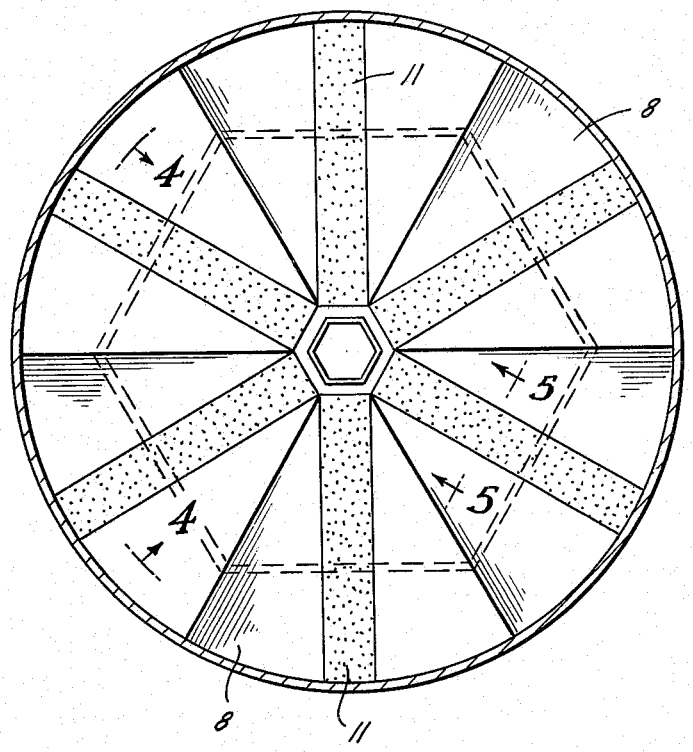
FIG. 2 is a top plan view of the slope sheet assembly.

In the drawings, the numeral 1 designates a tank having vertical walls and closed with the heads 2, 3. In the head 2 is mounted a normally closed vent 3, a coaming 4 and the normally closed manhole 5, and the load inlet line 6. On the head 3 is mounted the supports, as 7, which maintain the slope sheets 8, 8 in place. The slope sheets 8, 8 are designed to slope horizontally and vertically and are bent forming channels 10 in which the slides 9 are mounted. A metallic, porous plate 11 is mounted on each slide 9 and an air diffuser 12 is mounted in each slide and midway between the respective ends thereof, to direct the flow of incoming air over the entire slide plate where it will pass through the slide plate and premeate the material in the tank, causing the particles of material to be suspended in the air, thereby creating a material-air mixture which will be similar to a liquid in its flow characteristic, the air inlet line 13 directing air into the area beneath the slides and nipples 14 admitting this air into the area beneath the diffusers 12 in the slides 9.

An access ladder 15 is provided inside the tank beneath the manhole 5. Equalizing conduits 16, 17 are mounted in the tank and extend through the slope sheets 8 with their upper ends above the material level in the tank. In the conduit 16, a differential relief valve 18 is mounted that will hold a back pressure of four PSI on the area beneath the slope sheets 8, so that the air introduced into the area beneath the slope sheets will be forced through the nipples and diffused into the material in the tank to accomplish aeration. Any pressure over four PSI will be directed into the area above the material and will tend to force the material downwardly against the slope sheets and slides. An inline check valve (not shown) is installed in the line 17, which prevents air flow through the line from beneath the slope sheets, but permits movement of air in the opposite direction, thus assuring that the pressure in the top of the tank will be equalized with the pressure in the bottom of the tank, and thus avoid damaging the air slides and slope sheets. A filter 19 is mounted in the pipe 17 above the level of the material in the tank, so that dust or fine granules of the material in the tank will not flow into the area of the tank beneath the slope sheets.

The primary use of the tank will be for transporting barite, cement, bentonite and other materials of like characteristics, in pulverulent form, used in drilling operations. The normal operating pressure in unloading the tank is forty PSI, with an air volume of 478 CFM to 600 CFM. The tank is cylindrical in shape and fabricated for vertical installation. The material to be transported is loaded into the tank through the inlet line 6. A discharge line 20 extends from a point in the vertical axis of the tank, adjacent the bottom head 3, with its lower end open, and just above the terminals of the slides 9. This discharge line extends upwardly and laterally, through the side wall of the tank, and connects with an outside line (not shown) of any desired length, which leads to the discharge point, such as a storage tank on the shore, or on a drilling platform. A jet line 21 is mounted in the inlet line 13 and in the discharge line 20, outside of the tank, and a valve 22 controls the air flow through the jet line 21.

In unloading, with all valves closed, the compressor is started, and a high volume of air is introduced into the dry pulverized material through the inlet line 13 and the slide plates 11, until a pressure of 40 PSI is reached in the tank, then the discharge line is fully opened, the material having become entrained with the air, will assume some of the characteristics of water, that is, it will seek its own level, and the air from above this level will apply pressure on the top of the mass of material-air mixture, and the mixture will flow to a center low point in the tank. The air line 13 is then regulated to maintain the pressure of forty PSI stabilized in tank and discharge line. In such fluidized condition, and under pressure, the material will flow through the discharge line to any point within a reasonable distance, depending upon numerous factors, such as the density of the material and the consequent friction resistance, pressures, air volume, line sizes, bends in the line, etc. The vertical walls, slope sheets and slides are designed so that all such material will flow to the lower center, where it will enter the discharge line 20. The entire discharge line, from the tank to the point of discharge, will be pressurized and the friction resistance of the material flowing through the discharge line, will assist in maintaining the desired pressure on the tank. The air above the material-air mixture level will exert pressure on the mixture constantly urging same against the slope sheets, and when the mixture level drops below the discharge opening, the tank is empty and the pressure will drop to approximately four PSI. The cycle may then be repeated, if desired, to thoroughly clean the tank of all pulverized material. The void area of the tank created by the slope sheet, will be only about ten per cent of the total tank volume and the pressure equalization conduits extending through the slope sheets will protect the slope sheets from damage by pressures created in the tank When the mixture, because of density, builds up a resistance in the discharge line 20 that is sufficient to slow down or stop the travel of the mixture through the discharge line 20, the valve 22 may be opened and regulated to add a jet of air to the mixture in the discharge line, of sufficient pressure and velocity to maintain a steady flow of mixture to the ultimate destination.

What I claim is:

1. In a high volume pneumatic tank, vertical, cylindrical walls and concave-convex heads mounted on each end of said walls, horizontally and vertically inclined slope sheets mounted adjacent the head forming the bottom of the tank, an air slide mounted between the slope sheets and pourous slide plates mounted on said slides, a load inlet line and a load discharge line mounted in said tank, said discharge line extending from a point adjacent said slide plates to the point of ultimate discharge, an air inlet line beneath said slope sheets and pressure equalizing means for equalizing the pressure in the tank on each side of said slope sheets consisting of two conduits extending from beneath the slope sheets to a point above the content level inside the tank, one of said conduits permitting pressure flow in one direction and the other conduit permitting pressure flow in the opposite direction, said equalizing means has a filter to prevent pulverulent material from moving from one side of said slope sheets to the other, and means for maintaining a preselected pressure differential beneath said slope sheets.

* * * * *